US010881188B2

(12) United States Patent
McKelvey et al.

(10) Patent No.: US 10,881,188 B2
(45) Date of Patent: Jan. 5, 2021

(54) TRAVEL MIRROR ASSEMBLY AND METHOD OF USE

(71) Applicants: Sanni McKelvey, Lee's Summit, MO (US); Steve McKelvey, Lee's Summit, MO (US)

(72) Inventors: Sanni McKelvey, Lee's Summit, MO (US); Steve McKelvey, Lee's Summit, MO (US)

( * ) Notice: Subject to any disclaimer, the term of this patent is extended or adjusted under 35 U.S.C. 154(b) by 0 days.

(21) Appl. No.: 16/584,355

(22) Filed: Sep. 26, 2019

(65) Prior Publication Data

US 2020/0093242 A1 Mar. 26, 2020

Related U.S. Application Data

(60) Provisional application No. 62/736,869, filed on Sep. 26, 2018.

(51) Int. Cl.

| | |
|---|---|
| ***F21S 9/02*** | (2006.01) |
| ***F21V 23/04*** | (2006.01) |
| ***F21Y 115/10*** | (2016.01) |
| ***A45D 42/10*** | (2006.01) |
| ***A45D 42/16*** | (2006.01) |

(52) U.S. Cl.

CPC ..... *A45D 42/10* (2013.01); *A45D 42/16* (2013.01); *F21S 9/02* (2013.01); *F21V 23/04* (2013.01); *F21Y 2115/10* (2016.08)

(58) Field of Classification Search

CPC ..... F21V 33/0004; F21V 23/0414; F21V 21/145; F21V 21/406; F21V 13/045; F21V 14/065; F21V 21/30; F21V 9/083

USPC ..... 362/109, 135

See application file for complete search history.

(56) References Cited

U.S. PATENT DOCUMENTS

| | | | | |
|---|---|---|---|---|
| 7,090,378 | B1 * | 8/2006 | Zadro | A45D 42/10 362/109 |
| 7,347,573 | B1 * | 3/2008 | Isler | A45D 42/10 362/138 |
| 7,393,115 | B2 * | 7/2008 | Tokushita | A45D 33/006 362/140 |
| 2012/0200075 | A1 * | 8/2012 | Coore-Widener | A47B 19/002 281/29 |

* cited by examiner

*Primary Examiner* — William J Carter

(74) *Attorney, Agent, or Firm* — Law Office of Mark Brown, LLC; Christopher M. DeBacker

(57) ABSTRACT

A foldable, detachable travel mirror. It generally includes two halves joined at a central point such that the two halves can be folded together for transport or opened for a larger mirror. The central joining element could be fabric connecting the two halves using hook-and-loop fasteners, and can allow the two halves to be completely separated as desired. It includes light emitting diodes (LEDs) for providing light in low-light situations and a rechargeable battery for operating the LEDs. A standard universal serial bus (USB) charging cable could be used to recharge the battery. Hanging elements are affixed to either half of the mirror to allow hanging of the entire assembly in an unfolded orientation, or to hang each half when separated. The mirror face on each half would be preferably formed from acrylic rather than glass for safety, and would not include magnifying features.

5 Claims, 11 Drawing Sheets

TRAVEL MIRROR ASSEMBLY AND METHOD OF USE

CROSS-REFERENCE TO RELATED APPLICATION

This application claims priority in U.S. Provisional Patent Application No. 62/736,869 Filed Sep. 26, 2018, which is incorporated herein by reference.

BACKGROUND OF THE INVENTION

1. Field of the Invention

The present invention relates generally to a travel mirror and method for use thereof, and more specifically to a foldable transportable mirror for hanging and including lights.

2. Description of the Related Art

When traveling, especially during performances such as dancing or acting, people often have the need for a mirror to check their make-up, costume, or other elements of their person. However, space back-stage at performance events can be crowded and low-light. What is needed is a safe, hanging, portable travel mirror with built-in lights which can be deployed in any setting regardless of power source. Such a mirror would have uses to anyone, even outside of such situations as described.

Heretofore there has not been available a system or method for a travel mirror with the advantages and features of the present invention.

BRIEF SUMMARY OF THE INVENTION

The present invention generally provides a foldable, detachable travel mirror. It generally includes two halves joined at a central point such that the two halves can be folded together for transport or opened for a larger mirror. The central joining element could be fabric connecting the two halves using hook-and-loop fasteners, and can allow the two halves to be completely separated as desired. It includes light emitting diodes (LEDs) for providing light in low-light situations and a rechargeable battery for operating the LEDs. A standard universal serial bus (USB) charging cable could be used to recharge the battery. Hanging elements are affixed to either half of the mirror to allow hanging of the entire assembly in an unfolded orientation, or to hang each half when separated. The mirror face on each half would be preferably formed from acrylic rather than glass for safety, and would not include magnifying features.

An embodiment of the invention could provide a single mirror frame housing a single mirror with no joining element for a second mirror.

BRIEF DESCRIPTION OF THE DRAWINGS

The figures constitute a part of this specification and include exemplary embodiments of the present invention illustrating various objects and features thereof.

DETAILED DESCRIPTION OF THE PREFERRED EMBODIMENTS

I. Introduction and Environment

Figure 1:
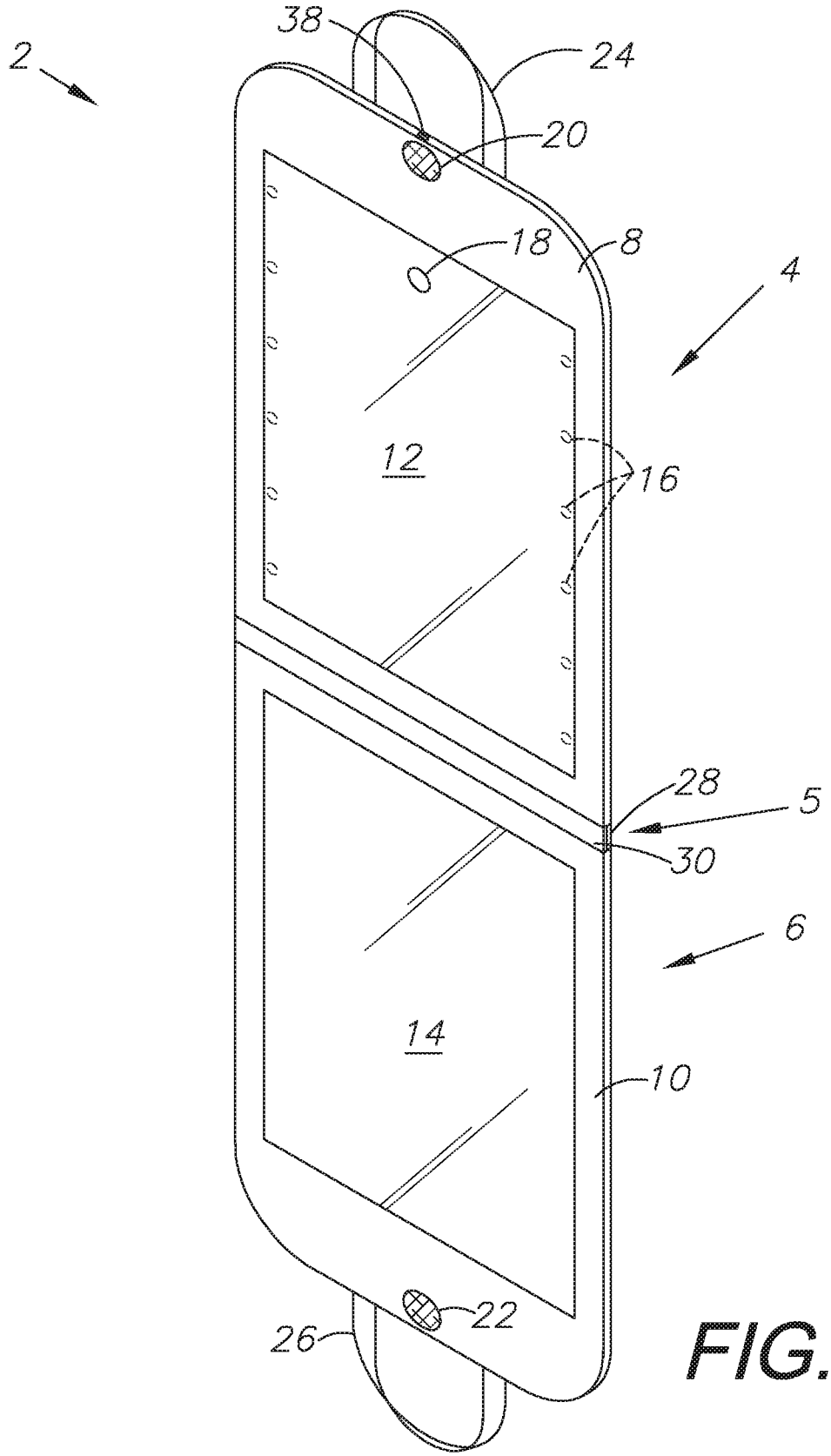
FIG. 1 is a three-dimensional isometric view of a preferred embodiment of the present invention shown in an open and unfolded orientation.
Figure 2:
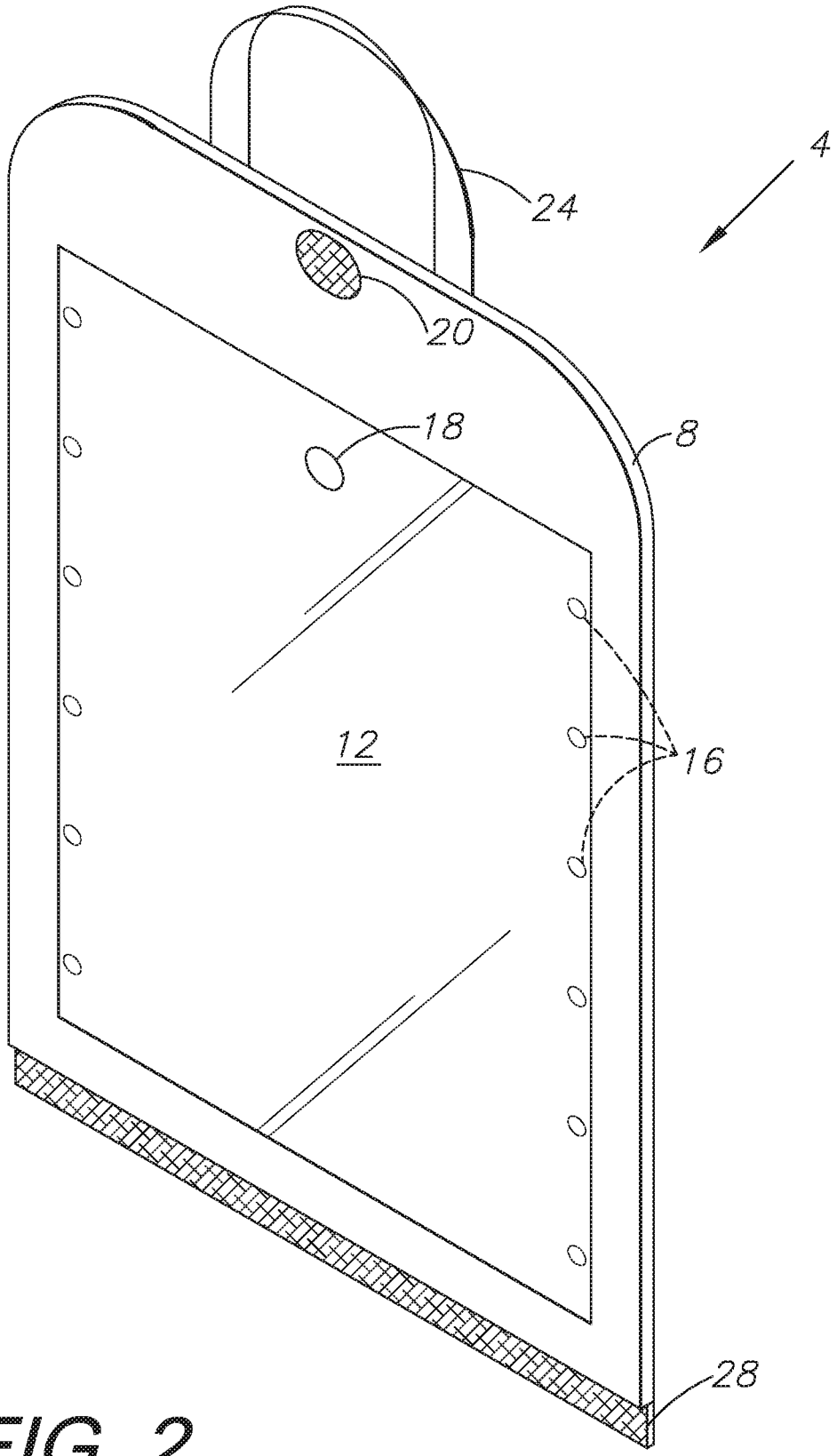
FIG. 2 is a three-dimensional isometric view of a top portion thereof.
Figure 3:
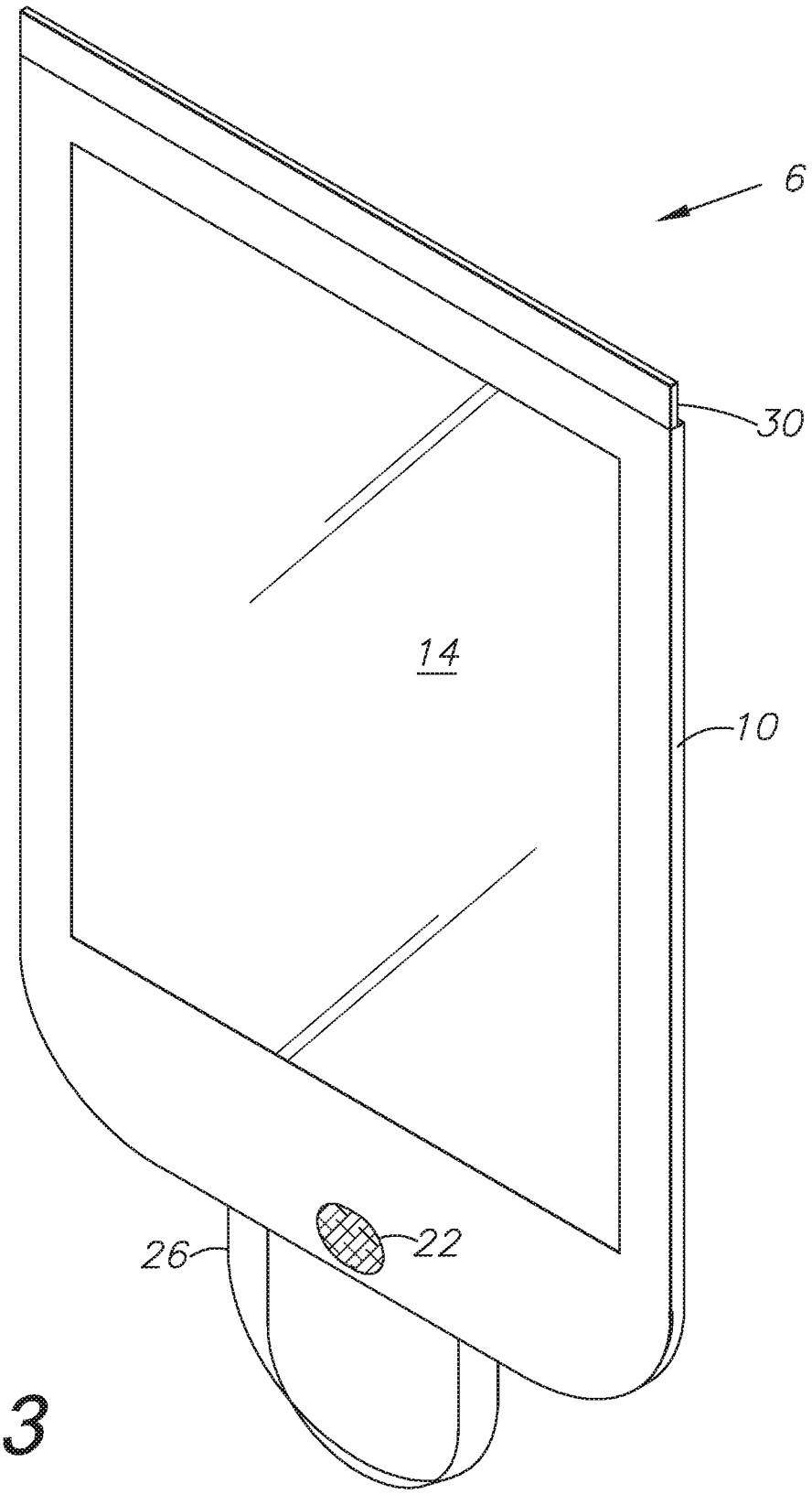
FIG. 3 is a three-dimensional isometric view of a bottom portion thereof.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Travel Mirror 2

As shown in the figures, the present invention provides a travel mirror 2 which consists of two halves, a top portion 4 having a top frame 8 and a bottom portion 6 having a bottom frame 10. Each half includes an acrylic mirrored surface 12, 14 for safety purposes as glass would be far too fragile and dangerous for travel purposes. The mirrored surfaces 12, 14 are contained within their respective top 8 and bottom 10 frames. The two halves may be joined by a central connection 5 using flexible tabs 28, 30 having hook-and-loop fasteners or other joining elements.

Figure 10:
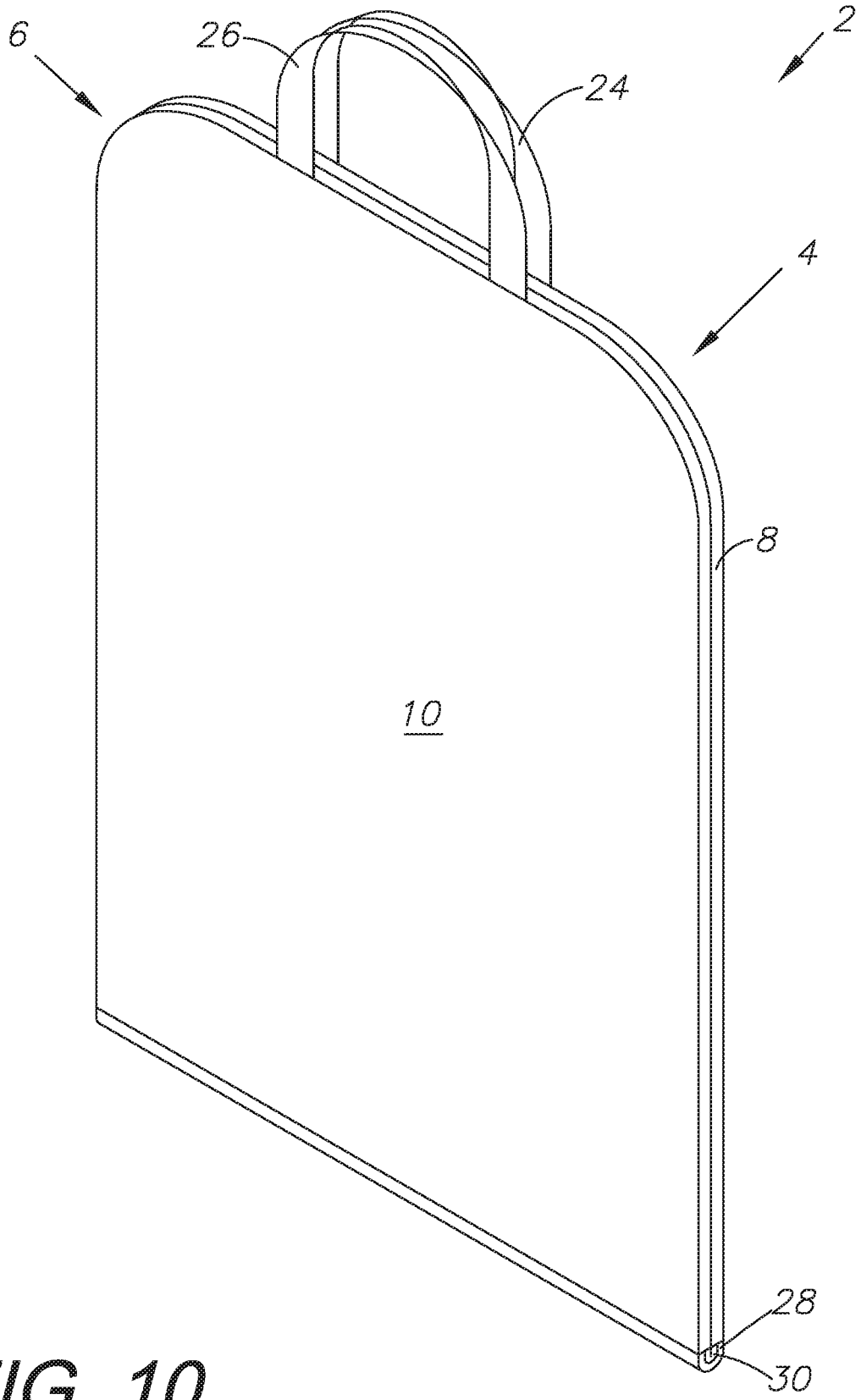
FIG. 10 is a three-dimensional isometric view of the embodiment of FIG. 1 shown in a folded, travel orientation.

As shown in FIG. 10, the central connection allows the two halves to be folded together for storage and travel. The two tabs may be able to allow the two halves to be selectively disconnected. When folded together, a pair of hook and loop fasteners 20, 22 connect the two halves together to prevent accidental unfolding.

Figure 4:
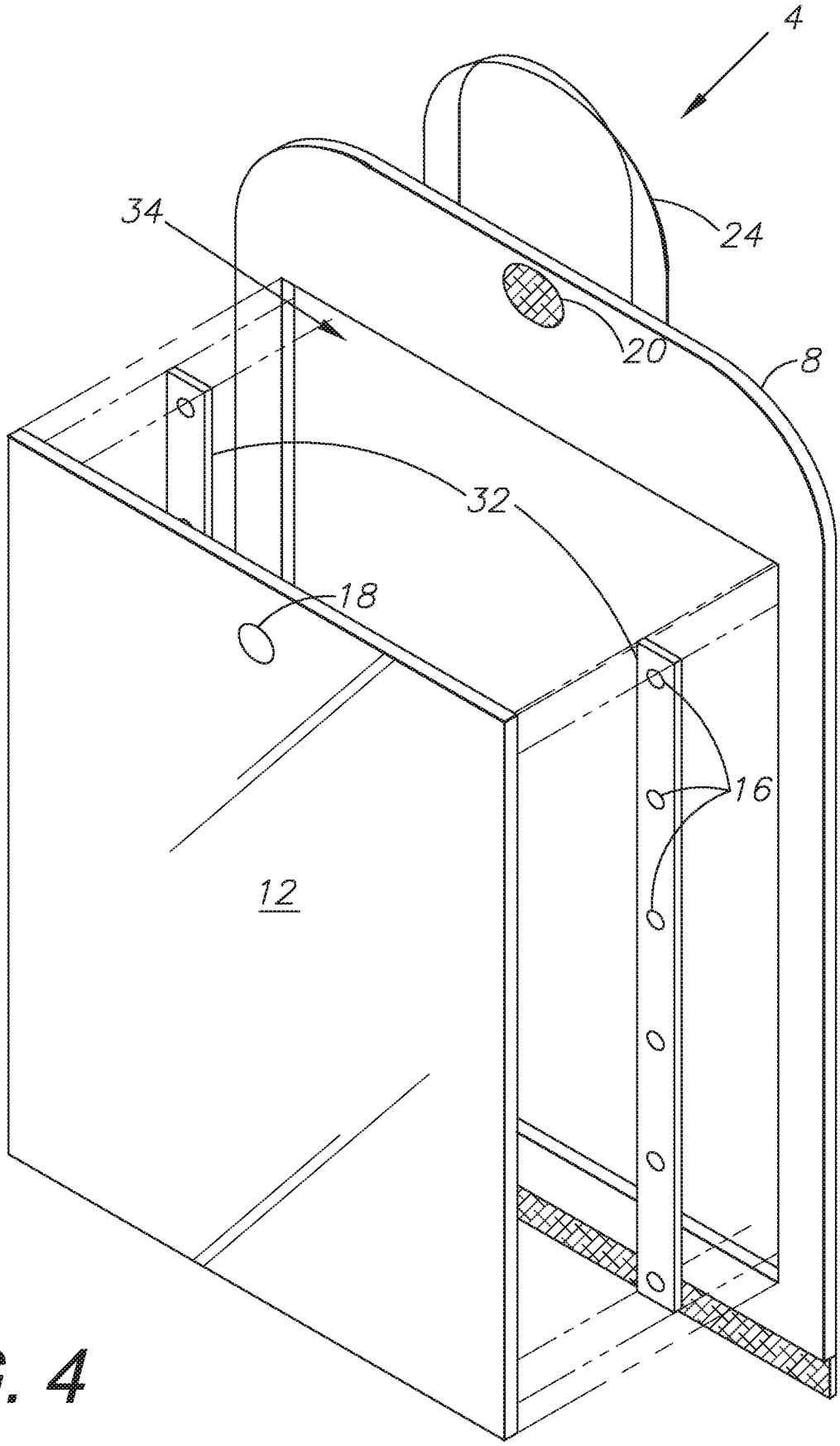
FIG. 4 is a partially-exploded three-dimensional isometric view of the top portion thereof.
Figure 5:
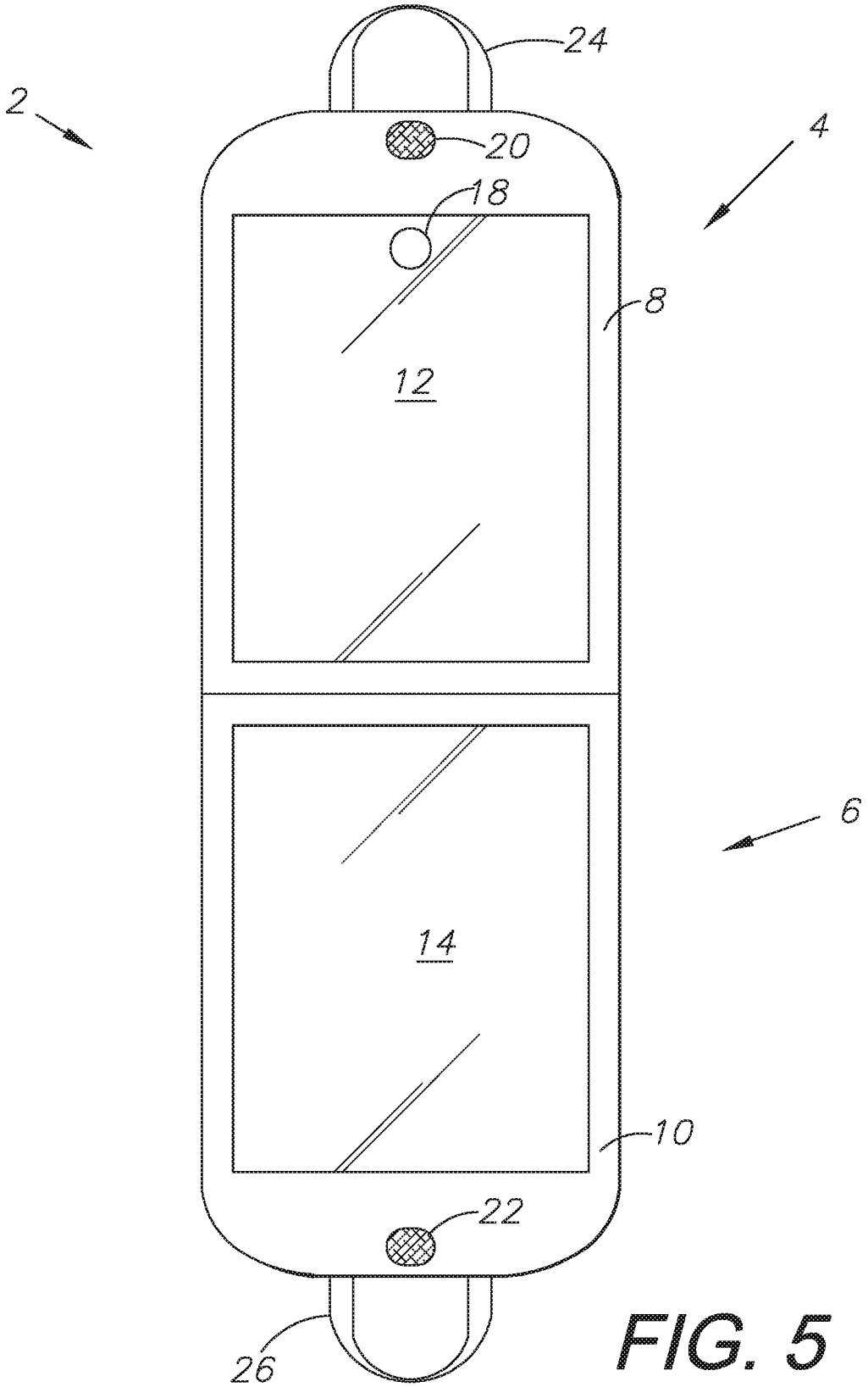
FIG. 5 is a front elevational view of the embodiment of FIG. 1.
Figure 6:
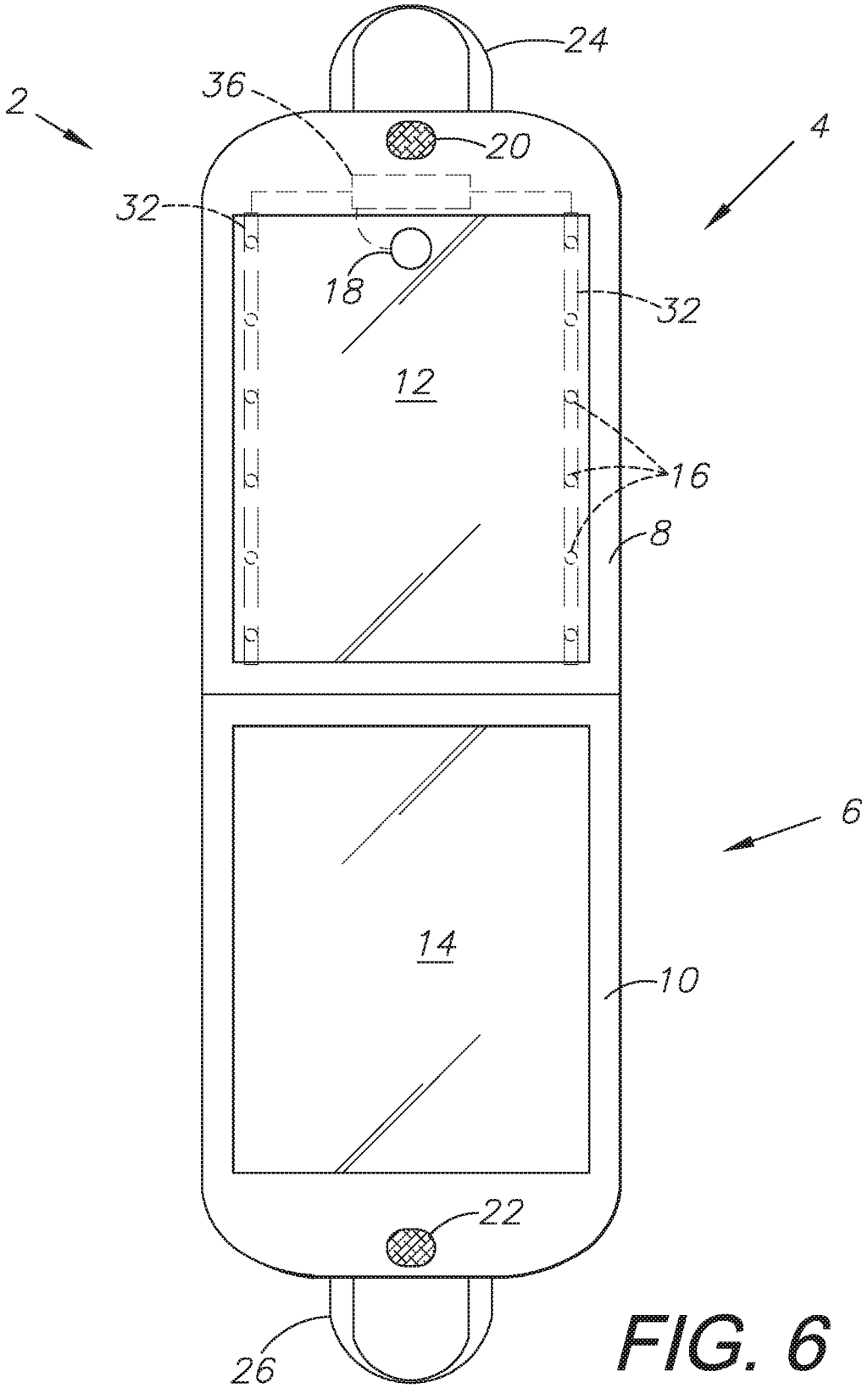
FIG. 6 is a front elevational view thereof showing elements contained within the structure thereof.
Figure 7:
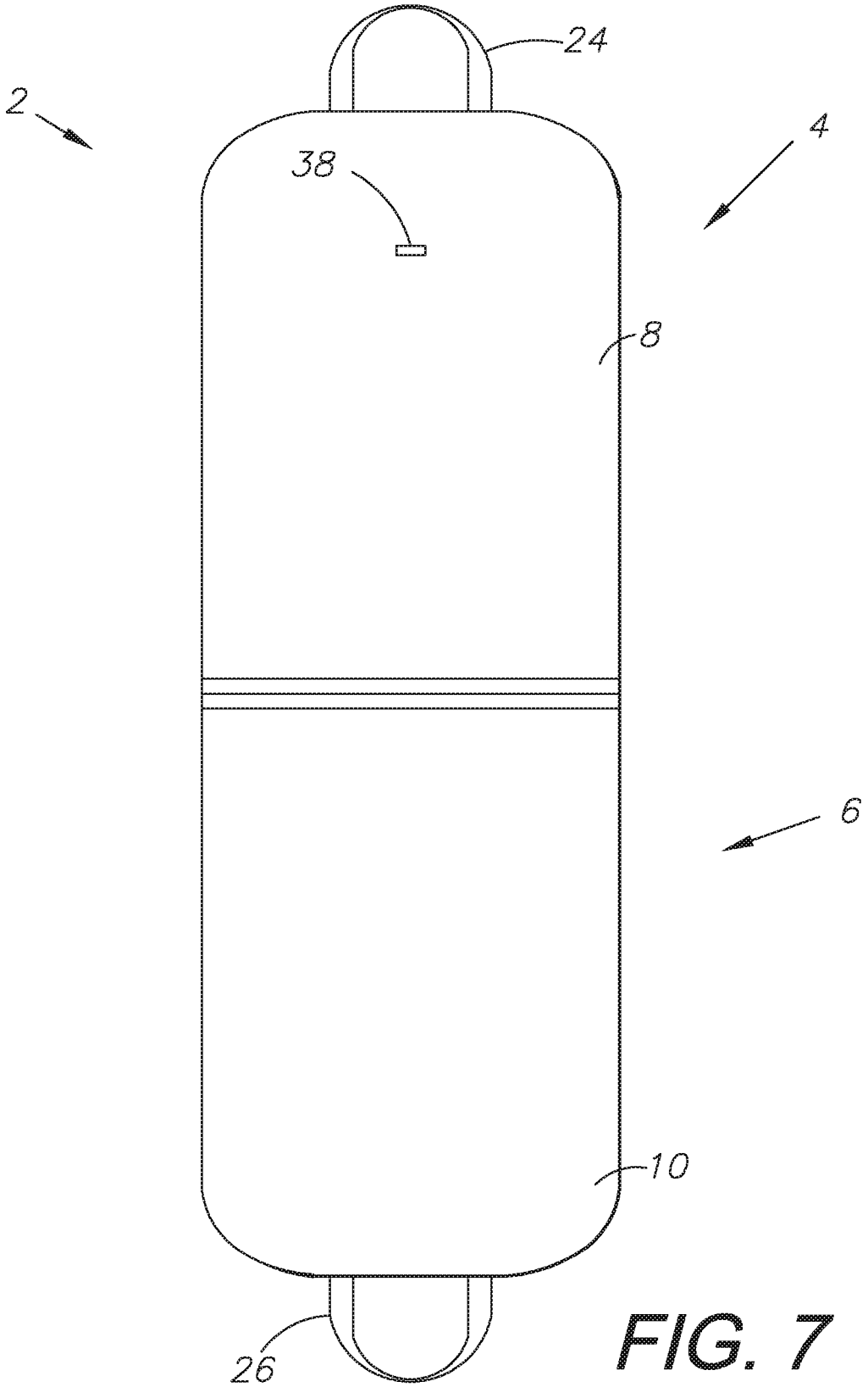
FIG. 7 is a rear elevational view thereof.
Figure 8:
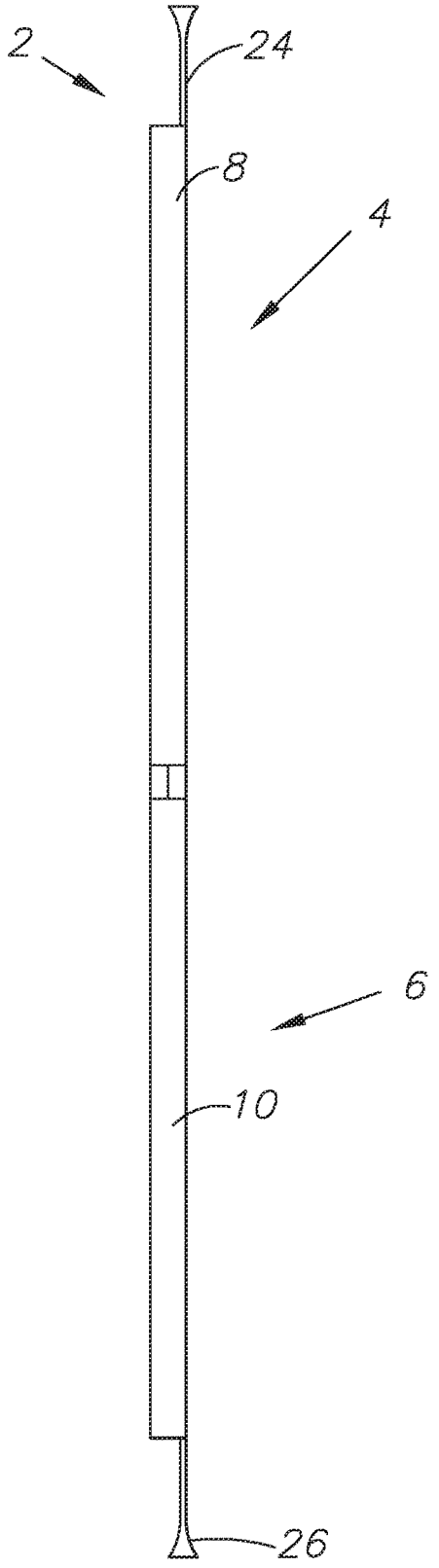
FIG. 8 is a side elevational view thereof.
Figure 9:
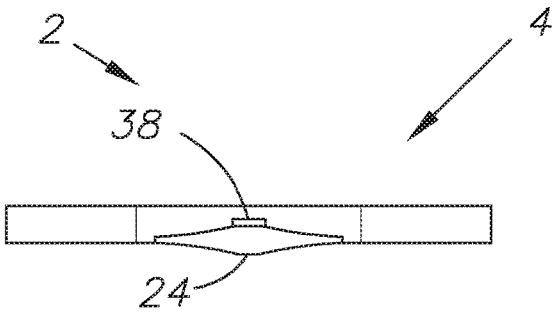
FIG. 9 is a top plan view thereof.

One or both halves of the mirror may include light emitting diodes (LEDs) 16 for lighting purposes. A rechargeable battery 36 including a charging port 38 for use with a USB cable or other charging cable powers the LEDs 16. As shown in FIG. 4, the top portion 4 includes a cavity 34 for receiving the mirror 12, and behind the mirror are two strips 32 of LEDs 16 which are connected to the battery 36. A power switch 18 may be connected through the mirror 12 to the battery 36 and LED 16 strips 32. The LEDs shine through the mirror 12 when activated. A similar setup could be included with the lower portion 6 if desired.

Each half also includes a hanger 24, 26 for allowing each half to be hung from a vertical surface, either individually or when joined by the central connector.

The mirror system 2 can be hanged by one of the hangers 24, 26 and the LEDs 16 can be activated via the switch 18 which shines light through the mirror 12. The lower portion 6 can be selectively removed via the flexible tabs 28, 30 of the central connection 5 to be utilized separately as needed, or may remain hanging from the first portion 4 for a larger mirror.

III. Alternative Embodiment Mirror System 102

Figure 11:
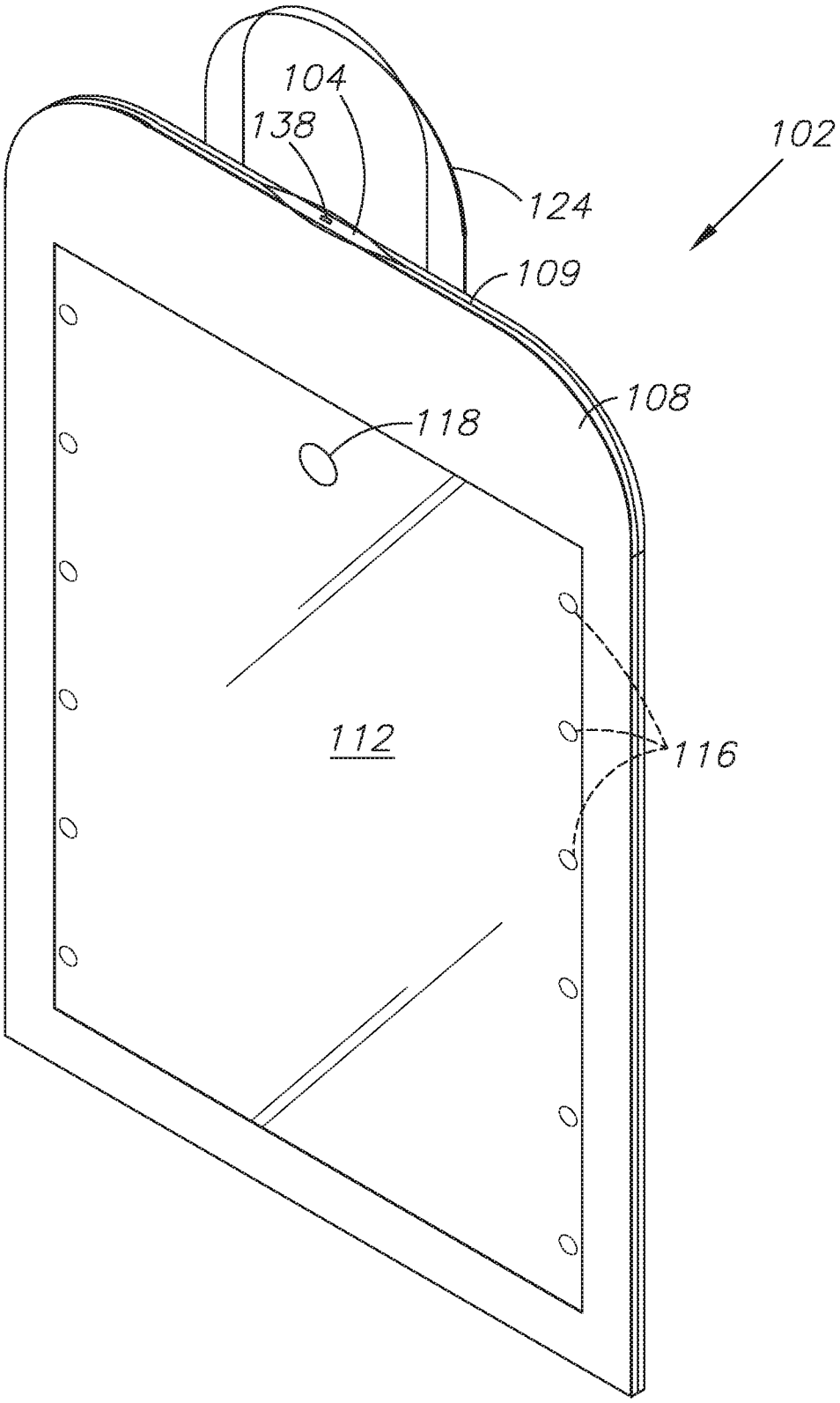
FIG. 11 is a three-dimensional isometric view of an alternative embodiment of the present invention.
Figure 12:
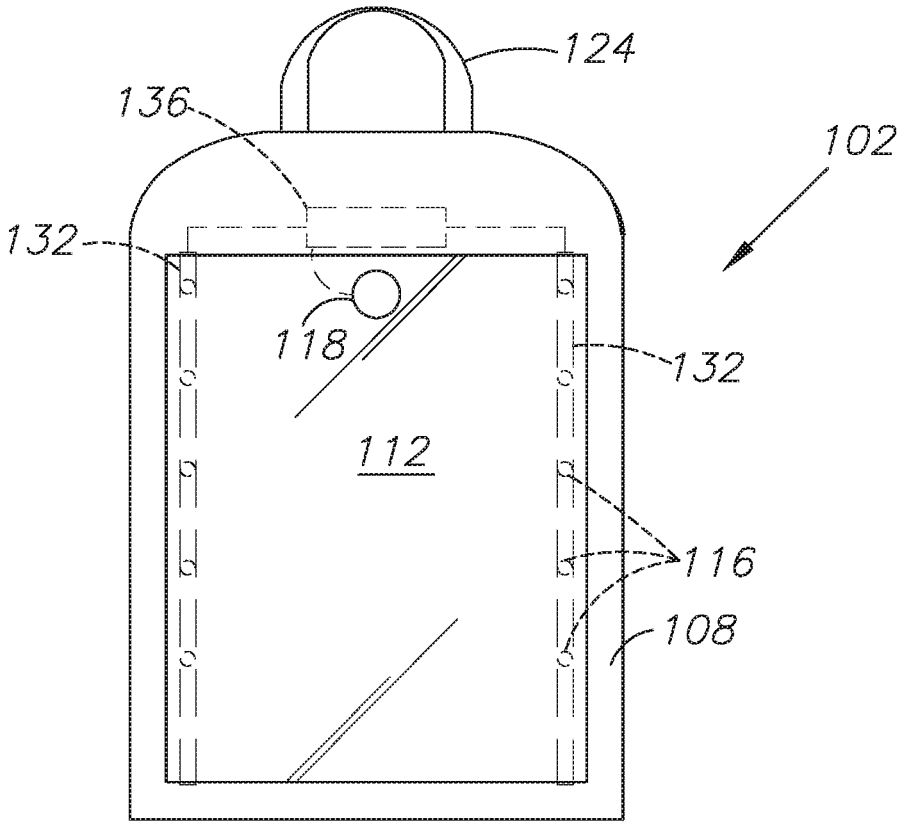
FIG. 12 is a front elevational view thereof showing elements contained within the structure thereof.

FIGS. 11 and 12 show an alternative embodiment mirror system 102 which features only a single mirror element having a frame 104 for housing a mirror 112, and a decorative and protective cover 108 covering the frame 104. A seam 109 joins the cover 108, and also conceals the charging port 138. A hanger 124 allows the mirror system 102 to be hung from a surface.

As with the embodiment above, the mirror system 102 includes light emitting diodes (LEDs) 116 for lighting purposes. A rechargeable battery 136 connected to the charging port 138 for use with a USB cable or other charging cable powers the LEDs 116. Behind the mirror 112 are two strips 132 of LEDs 116 which are connected to the battery 136. A power switch 118 may be connected through the mirror 112 to the battery 136 and LED 116 strips 132. The LEDs shine through the mirror 112 when activated. A similar setup could be included with the lower portion 6 if desired. The mirror 112 is able to be thin because of the acrylic material it is formed from.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A mirror system comprising:

a first portion comprising a first frame containing a first mirrored surface;

a second portion comprising a second frame containing a second mirrored surface;

said first and second portions connected via a central connection;

a plurality of light emitting diodes (LEDs) deployed behind said first mirrored surface and connected to a switch and battery, such that said switch is configured to activate said plurality of LEDs which shine through said first mirrored surface;

said first portion and said second portion selectively transformable from a first, open orientation to a second, closed orientation by folding said second portion onto said first portion about said central connection;

said central connection comprising a first flexible tab affixed to said first portion and a second flexible tab affixed to said second portion such that said central connection provides a flexible hinge where said first flexible tab is laid atop said second flexible tab;

said first tab and said second tab configured to be connected via a fastener; and said first tab and said second tab being selectively detachable via said fastener.

2. The mirror system of claim 1, wherein said fastener comprises a hook and loop fastener.

3. The mirror system of claim 1, wherein said first and second mirrored surfaces each are comprised of an acrylic material.

4. A method of using a mirror, the method comprising the steps:

deploying a mirror assembly, the mirror assembly comprising a first portion having a first frame and a first mirrored surface;

wrapping a cover about said frame, said cover comprising a seam having an opening about a charging port within said frame;

activating a switch;

drawing power from a power source within said mirror assembly;

activating a plurality of LEDs with said switch and powering said LEDs with said power source, said LEDs being deployed behind said first mirrored surface; and wherein said LEDs shine light through said mirrored surface away from said mirrored surface; connecting a second portion to said first portion, said second portion comprising a second frame and a second mirrored surface; folding said first portion onto said second portion, thereby transforming said mirror assembly from a first, open orientation to a second, closed orientation; connecting said second portion to said first portion via a first flexible tab of said first portion and a second flexible tab to said second portion, such that said first flexible tab lays atop said second flexible tab and wherein said first tab and said second tab thereby create hinge about which first portion and said second portion may bend.

5. The method of claim 4, further comprising the step: hanging said mirror assembly by a hanger element connected to said cover.

* * * * *